US006689447B2

(12) United States Patent
Prevost

(10) Patent No.: US 6,689,447 B2
(45) Date of Patent: Feb. 10, 2004

(54) ARTIFICIAL SURFACE WITH INTEGRATED THERMAL REGULATION FOR SPORTS AND OTHER USES

(75) Inventor: Jean Prevost, Westmount (CA)

(73) Assignee: Fieldturf, Inc., Montreal (CA)

( * ) Notice: Subject to any disclaimer, the term of this patent is extended or adjusted under 35 U.S.C. 154(b) by 0 days.

(21) Appl. No.: 10/246,546

(22) Filed: Sep. 19, 2002

(65) Prior Publication Data

US 2003/0056432 A1 Mar. 27, 2003

Related U.S. Application Data

(60) Provisional application No. 60/323,718, filed on Sep. 21, 2001.

(51) Int. Cl.[7] ..... A41G 1/00

(52) U.S. Cl. ..... 428/87; 428/17; 428/95; 428/323; 47/1.01 F

(58) Field of Search ..... 428/15, 17, 85, 428/87, 95, 323; 47/1.01 F

(56) References Cited

U.S. PATENT DOCUMENTS

| | | | |
|---|---|---|---|
| 4,462,184 A | 7/1984 | Cunningham | |
| 5,064,308 A | 11/1991 | Almond et al. | |
| 5,120,158 A | 6/1992 | Husu | |
| 5,596,836 A | 1/1997 | Benson | |
| 5,850,708 A | 12/1998 | Bergevin | |
| 5,958,527 A | 9/1999 | Prevost | |

FOREIGN PATENT DOCUMENTS

| | | | |
|---|---|---|---|
| FR | 2 514 046 | 4/1983 | ..... E01C/13/00 |
| JP | 02-269207 | * 11/1990 | |
| JP | 07 317011 | 3/1991 | ..... E01C/11/26 |
| JP | 07-317010 | * 12/1995 | |
| JP | 09 203007 | 8/1997 | ..... E01C/13/08 |
| WO | WO 02 075053 | 9/2002 | ..... E01C/13/08 |

* cited by examiner

*Primary Examiner*—Deborah Jones
*Assistant Examiner*—Wendy Boss
(74) *Attorney, Agent, or Firm*—Ogilvy Renault; Wayne H. Yan

(57) ABSTRACT

A synthetic grass surface includes widely spaced rows of ribbons projecting from a flexible backing sheet. Thermal regulating means are attached to the backing sheet in the spaces between the rows of the ribbons. A relatively thick infill layer is disposed on the top of the backing sheet, thereby burying the thermal regulating means and holding the ribbons upright. The infill layer may include a growing medium for plant growth. In one embodiment, electric cables are integrated into the synthetic grass surface in order to heat the surface for de-icing or to maintain plant root warmth. In another embodiment, perforated flexible pipes are integrated into the synthetic grass surface to moisten the surface, thereby cooling the surface when the moisture evaporates. The thermal regulating system of the invention is energy-efficient and economical to install and operate.

23 Claims, 3 Drawing Sheets

ARTIFICIAL SURFACE WITH INTEGRATED THERMAL REGULATION FOR SPORTS AND OTHER USES

CROSS-REFERENCE TO RELATED APPLICATIONS

This application claims benefit of the priority of Applicant's U.S. Provisional Application Serial No. 60/323,718, filed on Sep. 21, 2001.

FIELD OF THE INVENTION

The invention relates to a synthetic grass turf with infill therein to provide an artificial surface for sports and for growing vegetables and other plants, more particularly to a synthetic grass turf with integrated thermal regulation to control the thermal conditions of the artificial surface.

BACKGROUND OF THE INVENTION

As is well known, the construction of a good quality all weather grass playing surface and its maintenance for recreational purposes and active sports, such as soccer and football, has been a problem of long standing.

Recent attempts at resolving this problem have resulted in the use of artificial surfaces to replace natural grass surfaces which do not stand up well to wear, and which require a great deal of maintenance. Also, natural grass surfaces do not grow well in partially or fully enclosed sports stadiums. A synthetic grass surface stands up to wear much better than the natural grass surfaces, does not require as much maintenance and can be used in closed stadiums. An improved synthetic grass surface is described in the Applicant's Canadian Patent Application 2,218,314, entitled SYNTHETIC TURF, which was filed Oct. 16, 1997, and was published on Sep. 10, 1998. The synthetic grass surface described in this patent application comprises widely spaced rows of synthetic ribbons representing grass fibers. The ribbons have a length of about twice the length of the spacing between the rows of ribbons. A particulate material is laid on a matrix of the synthetic grass, and the thickness of the particulate material is at least two thirds of the length of the ribbons. The strips of ribbons are attached by strips of bonding material applied to the back of the matrix or mat. The strips of bonding material are spaced apart and leave an area of mat un-coated, thereby providing improved drainage.

The particulate material of the infill is further described in the Applicant's U.S. Pat. No. 5,958,527, entitled PROCESS OF LAYING SYNTHETIC GRASS, issued on Sep. 28, 1999.

Under cold climatic conditions in open stadiums, the synthetic grass turf could be heated to melt snow or ice which covers the synthetic grass turf in order to maintain the adequate properties required for sport playing surfaces. When the synthetic grass turf is used under very warm climatic conditions, however, the cooling of the grass turf is desirable.

Heating systems have been developed for thawing and drying both natural and synthetic grass surfaces, such as electrical, fluid and air heating systems. Electrical heating is implemented by means of electrical resistance elements, fluid heating by communicating heating fluid through a network of heating pipes and air heating by communicating heated air through a distribution pipe network. Conventionally, these electrical resistance elements, fluid heating pipes and air distribution pipe networks are buried in a substrate of the playing field beneath the natural or synthetic grass turf. Examples of the electrical heating, fluid heating and air heating are described, respectively, in U.S. Pat. No. 5,046,308 which issued to Alnond et al. on Nov. 12, 1991, U.S. Pat. No. 5,120,158 which issued to Husu on Jun. 9, 1992 and U.S. Pat. No. 4,462,184 which issued to Cunningham on Jul. 31, 1984.

During warm climatic conditions, synthetic grass turf surfaces are to be cooled, conventionally, by providing moisture to the synthetic surface and circulating cool water beneath the synthetic surface. This is also described in U.S. Pat. No. 4,462,184.

Furthermore, it is also desirable to have a thermal regulating system for an artificial surface having organic growing media for growing plants in order to meet specific temperature requirements for the roots of plants.

The disadvantage of conventional heating systems lies in that a large portion of the heat energy is wasted and only a small amount of the heat energy reaches the surface for melting snow or ice coverage on the top of the surface, because the electrical resistance elements and pipe systems are buried in the playing field beneath the natural grass turf or the synthetic surfaces, usually in a substrate of the field. Therefore, a large portion of the heat energy is consumed heating the substrate while heating the surface of the playing field.

Therefore, there is a need for an artificial surface having a heating and cooling system with improved thermal efficiency.

SUMMARY OF THE INVENTION

It is one object of the present invention to provide an artificial surface with integrated thermal regulation for sports and other uses.

It is another object of the present invention to provide an artificial surface for sports and other uses which includes a heating system having improved thermal efficiency.

It is a further object of the present invention to provide an artificial surface for sports and other uses which includes a cooling system having improved cooling efficiency.

The present invention is generally directed to an artificial surface with integrated thermal regulation for sports and other uses. The artificial surface comprises a synthetic turf base including a flexible backing sheet adapted to be positioned on a support substrate. An infill layer of a particulate material is disposed upon a top surface of the flexible backing sheet. The particulate material is selected from at least one of a group of materials consisting of hard granules, resilient granules and a growth medium. The artificial surface further includes a plurality of parallel rows of synthetic ribbons representing blades of grass, projecting upwardly from the flexible backing sheet and through the infill layer. A thermal regulating means is attached to the flexible backing sheet for controllably regulating a thermal condition of the synthetic turf base, the synthetic ribbons and the infill layer.

In accordance with one aspect of the present invention, the thermal regulating means comprises a flexible electric heating element adapted to be connected to an electrical power source to convert electric current into heat energy. The flexible electric heating element according to one embodiment of the present invention is flat and can be laminated to the flexible backing sheet. In another embodiment of the present invention, the flexible electric heating element comprises an electric cable attached to the top surface of the flexible backing sheet. The electrical cable is buried under the infill layer. The electric heating element preferably has a layout which includes a majority of elongate sections extending parallel to the rows of synthetic ribbons. The respective elongate sections are disposed in spaces between the rows of synthetic ribbons, and are laminated to the flexible backing sheet. Alternatively, the respective elongate sections are bonded to the top surface of the flexible backing sheet by means of hot-melt adhesive which has an activating temperature higher than a predetermined temperature at which the electric heating element converts electric current into heat. This method can be used to convert existing sports fields with these characteristics to heated fields.

The infill layer preferably comprises a heat distributing particulate material having a relative effective conducting property. The heat distributing particulate material is disposed at the bottom of the infill layer and in contact with the thermal regulating means in order to effectively regulate thermal conditions of the synthetic base, the synthetic ribbons and the infill layer, while providing the surface with a resilient property.

In another embodiment of the present invention, the infill layer comprises soil for growing plants on the artificial surface. The synthetic ribbons retain the soil on the artificial surface against wind erosion.

In accordance with another aspect of the present invention, the thermal regulating means comprises a flexible pipe which substitutes for the electric heating element and is adapted to be connected to a water source for circulation of the water therethrough. When hot water is circulated therethrough, the flexible pipe can be used as a heating device for the artificial surface. When cool water is circulated therethrough, the flexible pipe can be used as a cooling device for the artificial surface. When it is used as a cooling device, the flexible pipe is preferably perforated, such as drip irrigation pipes, and is in fluid communication with the infill layer by means of the perforation thereof. Thus, moisture can be provided to the infill layer and thereby generates a cooling function when the moisture evaporates. The moisture is also desirable, especially when the infill layer comprises a growth medium such as soil, for plant growth. In plant growth format, a secondary backing of the grass can be non-permeable to conserve water. The amount of water dispensed in the system can be monitored to reduce the evaporation process when sprinkling systems are used.

Similar to the electric heating element, the flexible pipe which is relatively fine is preferably arranged in a layout having a majority of parallel sections disposed between the rows of synthetic ribbons, and attached to the top surface of the flexible backing sheet, or alternatively, is integrated into the flexible backing sheet.

The electric heating element or the flexible water pipe is integrated into the artificial surface so that relatively little energy will be wasted in heating or cooling the support substrate beneath the artificial surface. Thus, higher performance and lower operating costs are achieved. The electric heating elements or the flexible water pipes can be conveniently affixed to the artificial surface either on site or during the manufacturing process, and the costly construction of an underground system is thereby eliminated.

Other advantages and features of the present invention will be better understood with reference to preferred embodiments described hereinafter.

BRIEF DESCRIPTION OF THE DRAWINGS

Having thus generally described the nature of the present invention, reference will now be made to the accompanying drawings, showing by way of illustration preferred embodiments thereof, and in which.

DETAILED DESCRIPTION OF THE PREFERRED EMBODIMENTS

Figure 1:
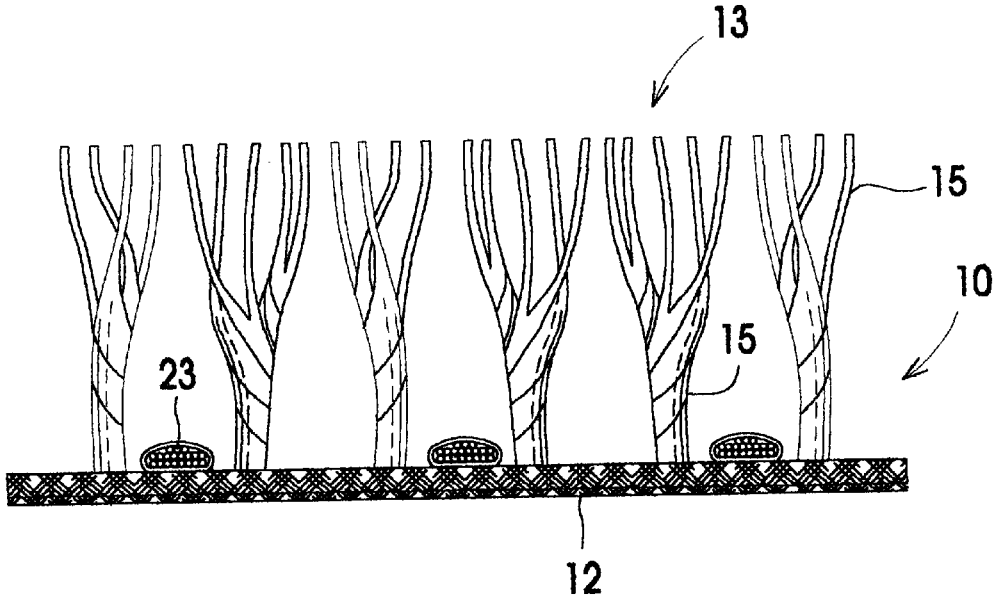
FIG. 1 is a cross-sectional view of an artificial surface according to one embodiment of the present invention, without an infill layer.
Figure 2:
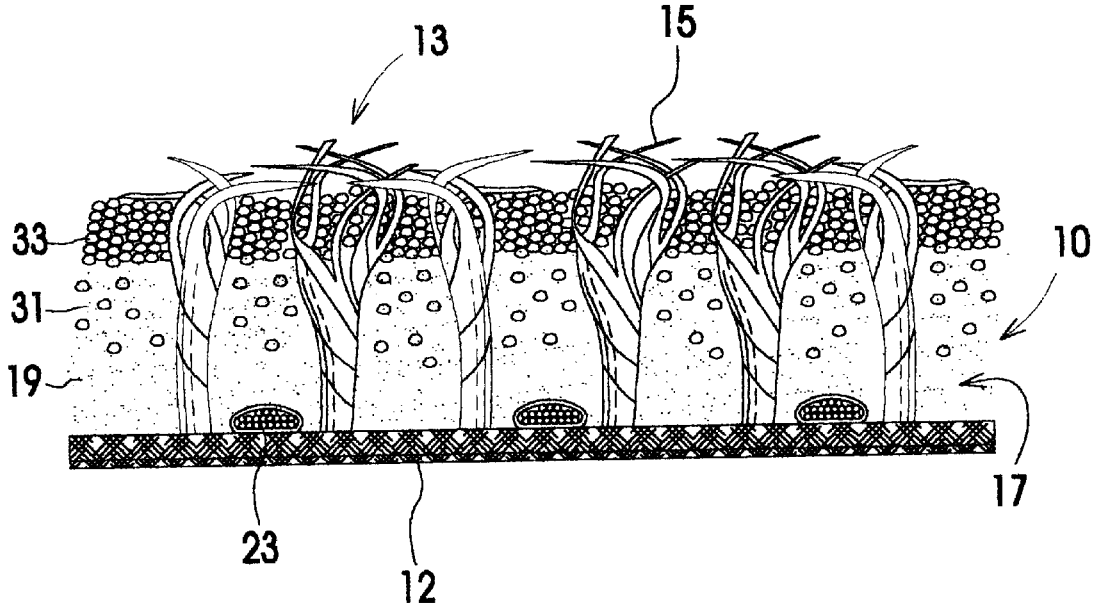
FIG. 2 is a view similar to that of FIG. 1, showing the infill layer disposed on the top of the backing sheet of the surface.

With reference to FIGS. 1 and 2, the synthetic grass surface generally indicated at numeral 10, of the present invention has a thin flexible backing sheet 12 with parallel rows 13 of synthetic strips or ribbons 15 projecting upwardly from the flexible backing sheet 12. A relatively thick layer 17 of infill particulate material is provided on the top of the flexible backing sheet 12 supporting the ribbons 15 in a relatively upright position on the backing sheet 12. The backing sheet 12 is adapted to be positioned on a support substrate (not shown).

Figure 3:
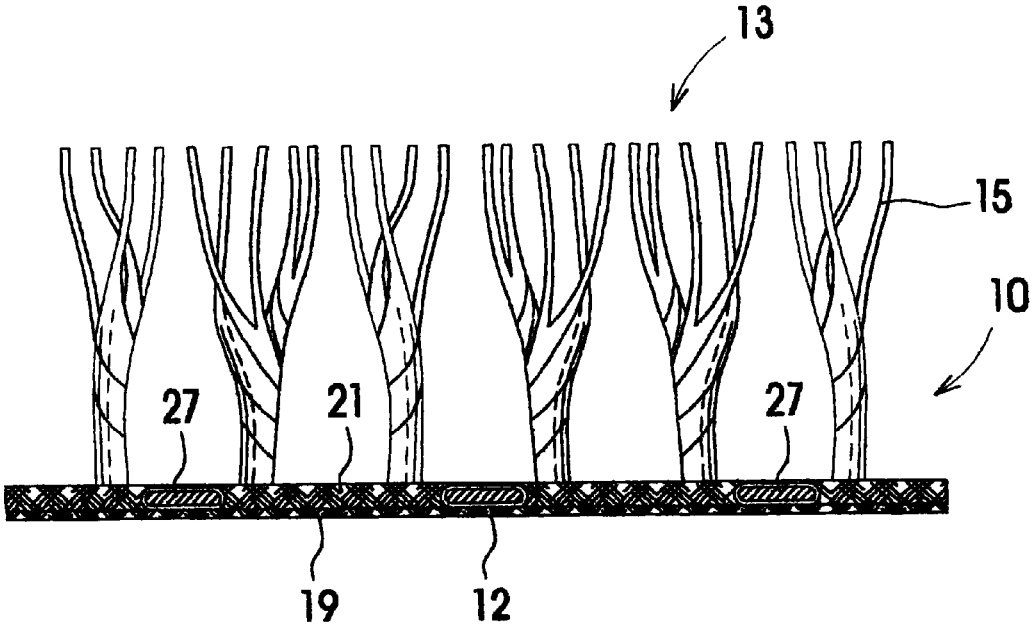
FIG. 3 is a cross-sectional view of the surface according to another embodiment of the present invention, without the infill layer.
Figure 6:
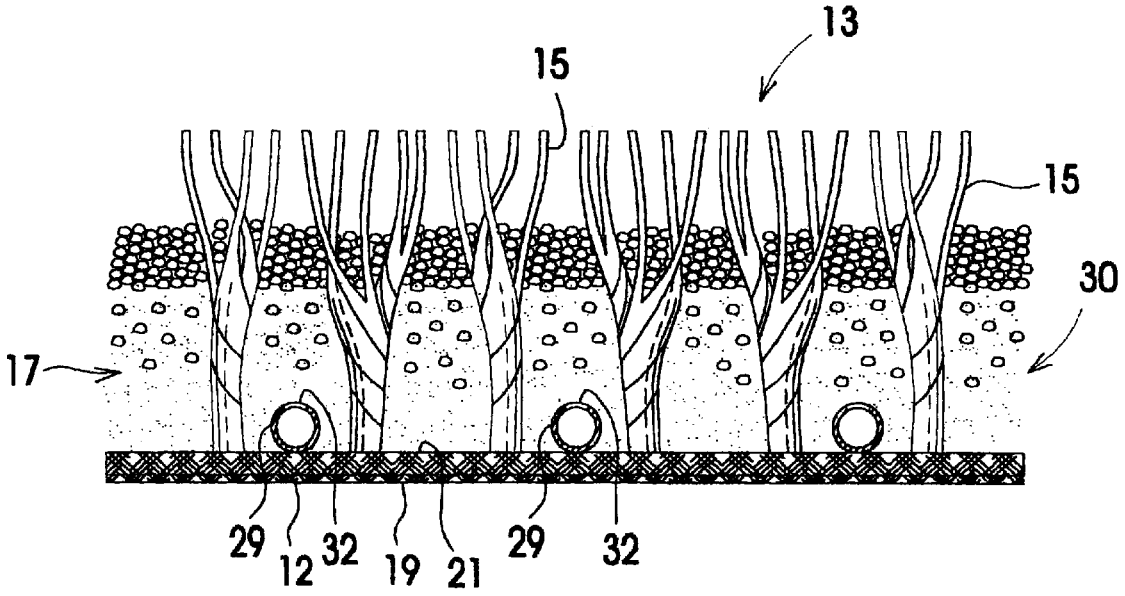
FIG. 6 is a cross-sectional view of the surface according to a further embodiment of the present invention, showing pipe sections attached to the backing sheet of the surface.

The flexible backing sheet 12, as indicated in FIGS. 3 and 6, comprises two layers 19, 21. The top layer 21 and bottom layer 19 can both be of woven or needle punched polypropylene fabric. The plastic strips or ribbons 15 are tufted through the backing sheet 12, passing through both layers 19 and 21.

While the backing sheet 12 has been shown as comprising two layers, it can also be formed from one layer or more. One or more of the layers in the flexible backing sheet 12 can be needle punched woven fabric to provide better drainage. At least the top layer 21 in the backing sheet 12 can be needle punched with synthetic fuzzy fibers (not shown) to provide means for wicking moisture through the layer. The fuzzy fibers further improve drainage of the surface.

The ribbons 15 are made from suitable synthetic material which is extruded in a strip which is relatively wide and thin. The preferred plastic material is polyethylene which is soft and has good abrasion resistance. However, polypropylene can also be used in making the ribbons 15.

The details of the backing sheet 12 and the ribbons 15 are described in the Applicant's published Canadian Patent Application 2,218,314 which is incorporated by reference herein, and will not be further described.

The spacing of the rows 13 of the ribbons 15 is dependent on the activity to be performed on the surface. For instance, cleats worn on the shoes of athletes for different sports have an average spacing of about three-quarters of an inch. Football cleats or soccer cleats may be spaced wider than baseball cleats. In sports such as horse racing, it is contemplated that much wider spacing will be required between the rows to accommodate the hooves of the horses. Thus, it is contemplated that for horse racing, a spacing between the rows of up to two and one-quarter inches could be necessary, with a proportionally longer ribbon of up to five inches for other uses.

It is noted that the rows 13 of the ribbons 15 are spaced apart between five-eighths inches and two and one-quarter inches and such spacing is adequate to allow an electric heating element or a flexible fine water pipe to be disposed therebetween. Therefore, it is possible to integrate a thermal regulation system into the surface 10 of the present invention.

In accordance with one embodiment of the present invention, and as illustrated in FIGS. 1 and 2, insulated electric heating cable sections 23 extend parallelly to the rows 13 of the synthetic ribbons 15 and are disposed in spaces between the rows 13 of the synthetic ribbons 15. The electric heating cable sections 23 can be connected in series as shown in FIG. 4, or in parallel connection as shown in FIG. 5.

Figure 4:
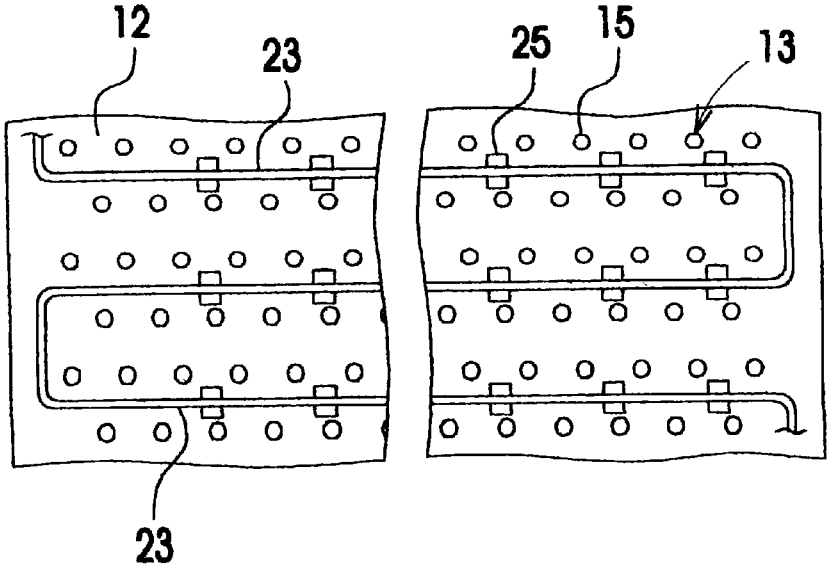
FIG. 4 is a schematic illustration of a layout of the thermal-regulating means integrated with the surface of the present invention.
Figure 5:
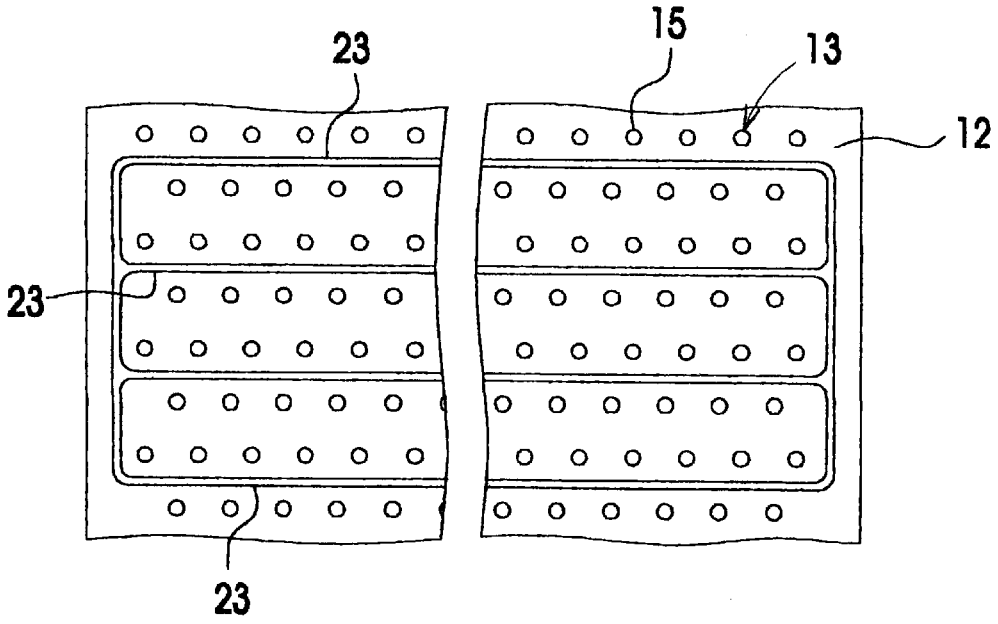
FIG. 5 is a schematic illustration of an alternative layout of the thermal-regulating means integrated with the surface of the present invention.

The electric heating cable sections 23 can be bonded to the top of the backing sheet 12 by means of a hot-melt adhesive 25, as shown in FIG. 4. The activating temperature of the hot-melt adhesive 25 is higher than the designated work temperature of the heating elements so that the bond of the electrical heating cable sections 23 with the flexible backing sheet 12 will remain intact and never release due to overheating. The bonding of the electric heating cable sections 23 to the flexible backing sheet 12 can be done either on site or during the manufacturing process. When it is done on site, the pieces of hot-melt adhesive 25 are distributed, as shown in FIG. 4, between the backing sheet 12 and the electric heating cable sections 23. The electric heating cable 23 is connected to an electric power source (not shown) having a voltage supply higher than the normal operating voltage and the electric heating cable sections 23 are thereby heated to the activating temperature, by way of a rheostadt for example, of the hot-melt adhesive 25 to melt the pieces of hot-melt adhesive 25. The electric heating cable sections 23 are bonded to the flexible backing sheet 12 when the power source is disconnected and the pieces of hot-melt adhesive 25 cool and become solid.

Alternatively, plastic clips (not shown) can also be used to secure the electrical heating cable sections 23 to the backing sheet 12. These clips could puncture the backing sheet 12 in order to attach themselves around the electric heating cable sections 23 and to the backing sheet 12. This would preferably be done during the manufacturing process.

In accordance with another embodiment of the present invention and as illustrated in FIG. 3, electrical conduits 27 are integrated into the backing sheet 12 of the artificial surface 10. The electrical conduits 27 could be made of thin heating cables of the types used for heating the eaves of roofs in order to melt snow, thereby reducing the risk of falling snow causing injury to people below. These cables can also be low voltage electrical conduits and can be modified according to the site requirements of the artificial surface 10. The electrical conduits 27 can be laminated between the two layers 19, 21 of the backing sheet 12, or laminated to the top of the backing sheet 12 by an additional lamination process during manufacture of the backing sheet 12. The synthetic ribbons 15 are then tufted into the backing sheet 12 between the sections of the electrical conduits 27.

Referring to FIG. 2, the infill layer of a particulate material is disposed upon a top surface of the flexible backing sheet 12 and the particulate material includes at least one of a group of materials consisting of hard granules, resilient granules and a growth medium. In one embodiment of the present invention, the artificial surface 10, which is generally used for sports, includes the infill layer 17 made up of a base course 29, a middle course 31 and a top course 33. The base course 29 substantially consists of hard granules disposed immediately upon the top surface of the backing sheet 12. The hard granules of the base course 29 are sand which is a very effective and low cost aggregate which can dissipate heat efficiently. Preferably, the hard granules of the base course 29 include sand as a first layer of the base course 29 and a second layer of additional and better heat dissipating material could be added, such as ceramic granules added to the top of the sand or mixed with the sand. These granules should be of a size generally equal to that of the sand granules so that the additional and better heat dissipating granules will not drop below and into the sand if such mix is not desired. These additional and better heat dissipating granules could facilitate more uniform dissipation of the heat over the horizontal plane of the artificial surface 10. These heat dissipating granules also can be used to cool the surface since they can absorb several times their weight in water thereby dissipating the moisture over a period of time. The middle course 31 of the infill layer 17 is a mixture of hard sand granules and resilient rubber granules. The mixture is selected on the basis of a weight ratio greater than 2:1 of hard and resilient granules respectively. The top course 33 of the infill layer 17 substantially consists of resilient rubber granules. The entire infill can also be made up of only rubber granules or only sand.

An upper portion of the synthetic ribbons 15 extends upwardly from a top surface of the top course 33 and preferably bends over the top surface of the top course 33 of the infill layer 17. This can be achieved by passing over the surface with a wire brush, for example, or by other brushing means, after installation of the top course 33 of the infill layer 17. The ends of the synthetic ribbons 15 are split, frayed or fibrillated, and interweave each other into a loose network in order to more realistically simulate the appearance of natural grass and thus increase their ability to hold or bind the top course 33 of the infill layer 17. The resulting artificial turf surface can be adapted for several indoor and outdoor uses, such as: athletic playing fields, horse racing tracks and recreational areas. The details of the infill layer 17 are described in the Applicant's U.S. Pat. No. 5,958,527 which is incorporated by reference herein. Nevertheless, the surface can also be installed without the need to fibrillate the fiber tips on site.

The above described infill layer 17 is only one example which could be used in the embodiment of the present invention and could include many different combinations of particulate materials, for example, substantially rubber, substantially sand, sand mixes, sand on the bottom with substantially rubber above, rubber and ceramic, and any other similar mixes. Other additives to the infill layer 17 which help the infill 17 dissipate the heat could be selected from a group of materials, besides sand and ceramic granules, including, for instance, glass granules, stone particulate, lava rock granules, steel pellets, coal slag granules and any other heat dissipating or transmitting granules. The heat dissipating or transmitting granules could enhance heat transfer in the artificial surface 10 farther from the electric heating cable or conduit sections 23, 27, which would thereby reduce the total length of heating cable 23 or electric conduit 27 required for an artificial surface 10. This results in a reduced total cost of the system both in installation and operation. Furthermore, the synthetic ribbons 15, or at least some of the total number of ribbons 15, could be made from heat reflecting material which would further improve heat transfer within the infill layer 17 of the artificial surface 10. The backing sheet 12, at least the top layer 21, can be made of heat reflecting fibers to that covering the backing sheet 12 would direct heat primarily upward to melt the ice and snow.

It is noted that the infill layer 17 can further include a growth medium, such as soil if the artificial surface 10 is to be used for growing vegetables or other plants. The roots could be maintained at a temperature warmer than the atmosphere in during cold climatic conditions. In such applications, the infill layer 17 can selectively include organic growing media only; organic growing media and some sort of inert material that enhances or retains heat; or organic growing media and ceramic beads which effectively retain moisture. Variations in the composition of an infill layer 17 can be selected to overcome growing difficulties under various climatic conditions, such as aridity and cold. The interwoven upper portions of the synthetic ribbons 15, as shown in FIG. 2, can effectively hold the growing medium against the effects of wind erosion so that the artificial surface 10 having the growing medium can be used in windy areas.

In order to retrofit a playing field or a landscaping surface using an infilled artificial surface of this type without the heating system originally installed, all that is required is to remove the infill layer by means of blowing it out with pressurized air, and then installing the electric heating cable sections needed, and hot-melting the adhesive in order to bond the cable sections in place. The infill layer is then replaced and the electrical connections can be completed at the perimeter of the artificial surface. The necessary electrical connections can be installed and positioned in boxes below ground at the periphery of the artificial surface. There would be no need to access any area under the field surface for heating system repairs after installation. The artificial surface, especially when used for sports, is designed to be heated in order to allow sports events to continue, even under severe weather conditions. A permanent power source for activating the heating system can be installed, however cost savings can be achieved by leasing a portable power plant on an as needed basis when the occasions of use are infrequent.

In operation, measures can be taken to reduce energy requirements. If a deep snow fall covers the artificial surface 10, most of the snow cover can first be removed by plows, scraping or other methods, and then the heating system need only address the residual snow. Sufficient heat is generated to maintain the infill layer 17 in its designed state, in which the infill layer 17 is not clumped and frozen. Once the artificial surface 10 reaches this point, the heating system can be immediately turned off to save energy costs.

The necessary start-up time required for the heating cables or electrical conduit 23, 27 to be only minutes. The time required to properly heat the surface could be a matter of minutes or hours, which is far less than conventional systems using heating fluids circulated through a series of pipes under the artificial surface 10 and in the substrate.

In an other embodiment of the present invention, as illustrated in FIG. 6, the artificial surface 30 includes a plurality of flexible fine pipe sections 29 which substitute for the electric heating element sections 23 or the electrical conduits 27 as illustrated in FIGS. 1 and 3. Other components and features are similar to the embodiments described with reference to FIGS. 1 through 5 and will not therefore be redundantly described. The components similar to those in FIGS. 1 through 5 are indicated by the same numerals in FIG. 6. The flexible fine pipe sections 29 can be the integral sections of one single pipe, similar to the layout illustrated in FIG. 4, or can be connected in fluid communication with parallel pipe connections as illustrated in FIG. 5. The pipe sections 29 are connected to a pump and water source (not shown) and water under pressure is circulated through the pipe sections 29. When hot water is circulated through the pipe sections 29, the infill layer 17 is heated. When the water temperature is below the ambient temperature of the artificial surface 30 during warm weather, the infill layer 17 can be cooled by cold water circulating through the pipe sections 29.

The pipe sections 29 can be affixed to the flexible backing sheet 12 either by adhesive material or clips. The pipe sections 29 can also be laminated to the backing sheet 12.

In order to obtain a more effective cooling result, the pipe sections 29 are preferably perforated so that the pipe sections 29 are in fluid communication with the infill layer 17 by means of the perforations 32. Water under pressure is circulated through the pipe sections 29 and a portion of the water enters the infill layer 17 through the perforations 32 of the pipe sections 29. The perforations 32 are evenly distributed along the pipe sections 29 and the water flow is controlled so that the water which enters the infill layer 17 does not flood the infill layer 17, but only moistens the particulate material of the infill layer 17 and the synthetic ribbons 15. The capillary action of the sand would allow the moisture to travel upwards in the infill and would therefore act as a coolant in the infill. Heat is removed from the infill layer 17 and the synthetic ribbons 15, as well as the backing sheet 12, when the moisture contained within the artificial surface 30 evaporates so that the temperature of the artificial surface is thereby reduced.

The temperature of water circulated through the pipe sections in this application is not necessarily below the ambient temperature because the cooling is achieved by evaporation rather than heat exchange.

In such an application, the layout illustrated in FIG. 5 is preferable for the pipe sections 29. The pipe sections 29 are connected in a parallel configuration which will reduce the loss of water pressure along the pipe length as opposed to the pipe sections 29 connected in series, as illustrated in FIG. 4. The moisture is thereby distributed more evenly within the entire area of the artificial surface 30. The embodiment shown in FIG. 6 can be used for the purpose of sports or recreational fields, or as a plant growing surface and the use will dictate the choice of particulate materials chosen for the infill layer 17.

It is noted that the artificial surface 30 including a growing medium in the infill layer 17, as shown in FIG. 6 is particularly effective for growing vegetables and plants. The moisture provided through the pipe sections 29 can not only be used as a cooling medium, but can also provide the necessary water supply to the vegetables or plants growing in the infill layer 17. Adequate water supply must be carefully controlled to prevent flooding the artificial surface 30, while maintaining cooling of the artificial surface 30. A secondary backing coating which is applied to the backing sheet 12 can be impermeable to the point where the amount of moisture allowed to flow through the perforated pipes is just enough to maximize the growing conditions for the specified plant.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

I claim:

1. An artificial surface with integrated thermal regulation for sports and other uses comprising:

a synthetic turf base including a flexible backing sheet adapted to be positioned on a support substrate;

an infill layer of particulate material disposed upon a top surface of the flexible backing sheet, the particulate material being selected from at least one of a group of materials consisting of hard granules, resilient granules and a growth medium;

a plurality of parallel rows of synthetic ribbons, representing blades of grass, projecting upwardly from the flexible backing sheet and through the infill layer; and a thermal-regulating means attached to the flexible backing sheet for controllably regulating a thermal condition of the synthetic turf base, the synthetic ribbons and the infill layer, the thermal-regulating means being disposed in direct contact with and buried by the infill layer.

2. The artificial surface as claimed in claim 1 wherein the thermal-regulating means comprises a flexible electric heating element adapted to be connected to an electric power source to convert electric current into heat energy.

3. The artificial surf ace as claimed in claim 2 wherein the flexible electric heating element is flat, and is laminated to the flexible backing sheet.

4. The artificial surface as claimed in claim 2 wherein the flexible electric heating element comprises an electric cable attached to the top surface of the flexible backing sheet, being buried under the infill layer.

5. The artificial surface as claimed in claim 2 wherein the flexible electric heating element comprises a layout thereof having a majority of elongate sections extending parallel to the rows of the synthetic ribbons and the respective elongate sections being disposed in spaces between the rows of the synthetic ribbons.

6. The artificial surface as claimed in claim 5 wherein the respective elongate sections are laminated to the flexible backing sheet.

7. The artificial surface as claimed in claim 5 wherein the respective elongate sections are bonded to the top surface of the flexible backing sheet by means of a hot melt adhesive having an activating temperature higher than a predetermined temperature at which the electric heating element converts electric current into heat energy.

8. The artificial surface as claimed in claim 1 wherein the thermal-regulating means comprises a flexible pipe adapted to be connected to a water source for circulation of the water therethrough.

9. The artificial surface as claimed in claim 8 wherein the, flexible pipe is perforated and is in fluid communication with the infill layer.

10. The artificial surface as claimed in claim 9 wherein the flexible perforated pipe is attached to the top surface of the flexible backing sheet, being buried under the infill layer.

11. The artificial surface as claimed in claim 9 wherein the flexible perforated pipe is integrated into the flexible backing sheet.

12. The artificial surface as claimed in claim 9 wherein the flexible perforated pipe comprises a layout thereof having a majority of perforated pipe sections extending parallel to the rows of the synthetic ribbons and the respective pipe sections being disposed in spaces between the rows of the synthetic ribbons.

13. The artificial surface as claimed in claim 1 wherein the infill layer comprises a heat distributing particulate material having a relative effective heat conducting property, the heat distributing particulate material being disposed at a bottom of the infill layer and in contact with the thermal-regulating means in order to effectively regulate thermal conditions of the synthetic base, the synthetic ribbons and the infill layer, while providing the artificial surface with a resilient property.

14. The artificial surface as claimed in claim 13 wherein the infill layer comprises:

a base course substantially of hard granules disposed upon the top surface of the flexible backing sheet;

a middle course of intermixed hard and resilient granules of a selective weight ratio, disposed upon the base course; and a top course substantially of resilient granules disposed upon the middle course, an upper portion of the synthetic ribbons extending upwardly from a top surface of the top course.

15. The artificial surface as claimed in claim 14 wherein the resilient granules comprise rubber.

16. The artificial surface as claimed in 14 wherein the hard granules are selected from at least one of the following materials; ceramic beads, glass granules, stone particles, lava rock granules, steel pellets, coal slag granules.

17. The artificial surface as claimed in claim 1 wherein the infill layer comprises soil.

18. The artificial surface as claimed in claim 1 wherein the infill layer comprises rubber granules.

19. The artificial surface as claimed in claim 1 wherein the infill layer comprises sand.

20. An artificial surface with integrated thermal regulation for sports and other uses comprising:

a synthetic turf base including a flexible backing sheet, adapted to be positioned on a supporting substrate;

an infill layer of particulate material disposed upon a top surface of the flexible backing sheet, the particulate material being selected from at least one of a group of materials consisting of hard granules resilient granules and a growth medium;

a plurality of parallel rows of synthetic ribbons representing blades of grass, projecting upwardly from the flexible tacking sheet and through the infill layer; and an electric heating element having a majority of elongate sections extending parallel to the rows of the synthetic ribbons, the respective elongate sections being disposed in spaces between the rows of the synthetic ribbons, attached to the top surface of the flexible backing sheet and adapted to be connected to an electric power source for controllably heating the synthetic turf base, the synthetic ribbons and the infill layer.

21. The artificial surface as claimed in claim 20 wherein at least a portion of the ribbons is made of a heat reflecting material.

22. The artificial surface as claimed in claim 20 wherein the backing sheet at least partially is made of a heat reflecting material.

23. An artificial surface with integrated thermal regulation for sports and other uses comprising:

a synthetic turf base including a flexible backing sheet, adapted to be positioned on a supporting substrate;

an infill layer of particulate material disposed upon a top surface of the flexible backing sheet, the particulate material being selected from at least one of a group of materials consisting of hard granules, resilient granules and a growth medium;

a plurality of parallel rows of synthetic ribbons, representing blades of grass, projecting upwardly from the flexible backing sheet and through the infill layer; and a flexible pipe having a majority of perforated pipe sections extending parallel to the rows of the synthetic ribbons, the respective flexible pipe sections being disposed in spaces between the rows of the synthetic ribbons, and attached to the top surface of the flexible backing sheet, the flexible pipe being in fluid communication through the perforations thereof with the infill layer and being adapted to be connected to a water source for controllable circulation of water therethrough for the purpose of moistening the infill layer so that the artificial surface is cooled when the moisture contained in the infill layer evaporates.

* * * * *